US008182616B2

(12) United States Patent
Kuecuek et al.

(10) Patent No.: US 8,182,616 B2
(45) Date of Patent: May 22, 2012

(54) DISHWASHER WITH A MODULAR STRUCTURE

(75) Inventors: Cengiz Kuecuek, Syrgenstein (DE); Bernd Schessl, Dillingen/Donau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1300 days.

(21) Appl. No.: 11/658,062

(22) PCT Filed: Jul. 22, 2005

(86) PCT No.: PCT/EP2005/053587

§ 371 (c)(1),
(2), (4) Date: Jan. 19, 2007

(87) PCT Pub. No.: WO2006/010743

PCT Pub. Date: Feb. 2, 2006

(65) Prior Publication Data

US 2008/0035183 A1 Feb. 14, 2008

(30) Foreign Application Priority Data

Jul. 23, 2004 (DE) ..... 10 2004 035 849

(51) Int. Cl.
*B08B 3/00* (2006.01)

(52) U.S. Cl. ..... 134/56 D; 134/57 D; 134/58 D

(58) Field of Classification Search ..... None
See application file for complete search history.

(56) References Cited

U.S. PATENT DOCUMENTS

| | | | | |
|---|---|---|---|---|
| 4,465,612 | A * | 8/1984 | Altenschopfer et al. | 134/22.1 |
| 5,368,379 | A | 11/1994 | Wrangberth | |
| 6,550,880 | B2 * | 4/2003 | Reuter | 312/265.3 |
| 2003/0205252 | A1 | 11/2003 | DeBoer et al. | |
| 2004/0003832 | A1 | 1/2004 | Jerg et al. | |
| 2005/0016569 | A1 | 1/2005 | Rosenbauer et al. | |
| 2005/0017609 | A1 | 1/2005 | Kuecuek et al. | |

FOREIGN PATENT DOCUMENTS

| | | | |
|---|---|---|---|
| DE | 75 20 122 U | | 4/1976 |
| EP | 0 351 564 | | 1/1990 |
| EP | 0 843 985 | | 5/1998 |
| EP | 0 950 749 | | 10/1999 |
| FR | 2 396 603 | | 2/1979 |
| FR | 2595937 | * | 9/1987 |
| GB | 1 227 699 | | 4/1971 |
| GB | 2 064 309 | | 6/1981 |
| GB | 2 271 417 | | 4/1994 |
| WO | WO 99/45188 | | 9/1999 |

OTHER PUBLICATIONS

Somaino, Giancario, Sep. 1987, FR 2595937, English translation.*
International Search Report PCT/EP2005/053587.

* cited by examiner

*Primary Examiner* — Michael Barr
*Assistant Examiner* — Jason Ko
(74) *Attorney, Agent, or Firm* — James E. Howard; Andre Pallapies

(57) ABSTRACT

A dishwasher with a rinsing container having the advantages of an inert, steel rinsing container, which is easy to produce and which can be adapted to differing requirements. Said aim is achieved in that the dishwasher is provided with a bottom module and a rinsing container, wherein the bottom group forms the bottom of the rinsing container and the top wall of the rinsing container consists of a separate top part. Production and mounting of the rinsing container is considerably simplified by preferably embodying the casing as a single part and by reduction of parts associated therewith, resulting in a reduction in production costs for the inventive dishwasher. Even when the height of the rinsing container varies, it is possible to use the same top part and bottom group; the height of the single-part casing simply needs to be adapted accordingly.

16 Claims, 1 Drawing Sheet

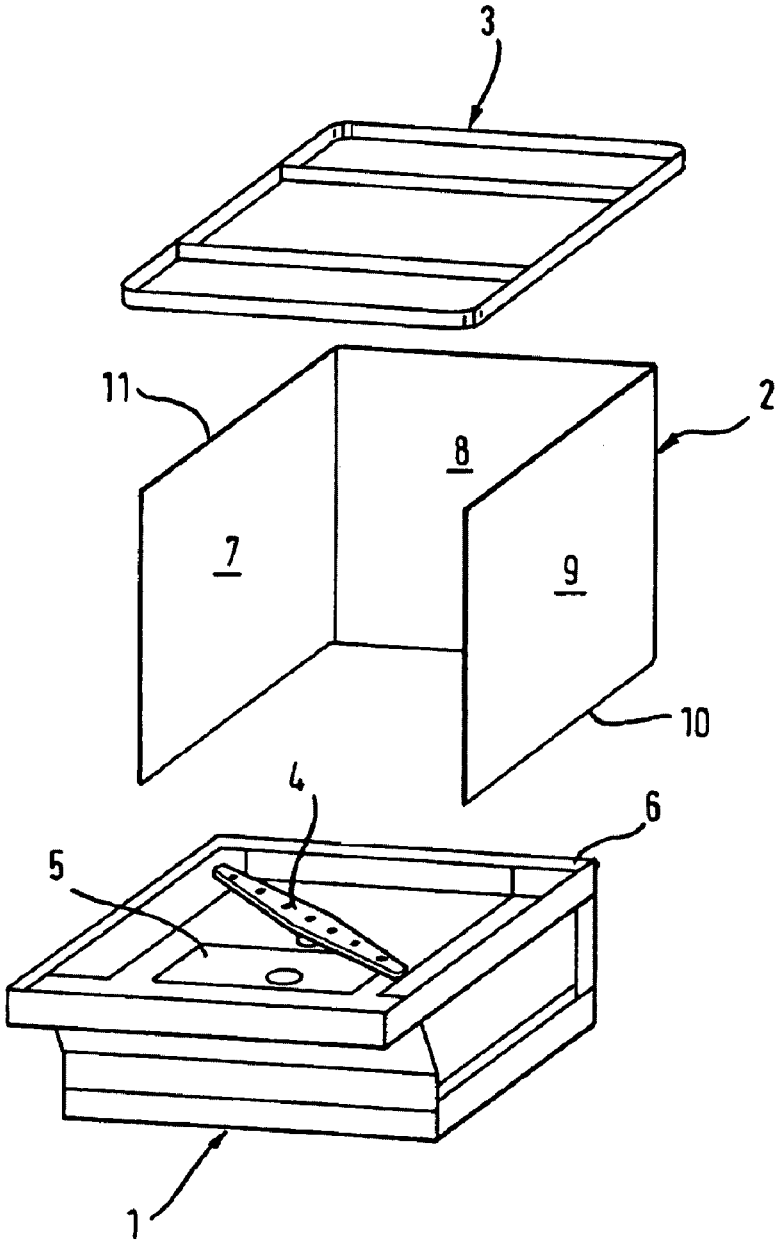
3
11
2
8
7
9
10
4
6
5
1

DISHWASHER WITH A MODULAR STRUCTURE

The invention relates to a domestic dishwasher which is designed with a bottom module which forms the bottom of the rinsing container.

BACKGROUND OF THE INVENTION

In dishwashers the rinsing container is generally formed from two refined steel sheet section. First refined steel sheet section is bent to the extent that it forms the two side walls and the top and bottom wall of the rinsing container and are connected to each other by roller seam welding, for example. A second refined steel sheet is welded onto this part as the rear wall of the rinsing container. This rinsing container is placed on a bottom module. After completion of the steel rinsing container it is fixed onto a so-called mounting bottom and the devices required, e.g. the pump pot, screen, etc. are accommodated in the rinsing container or in the mounting bottom below it. The manufacture of the steel rinsing container therefore requires a multiplicity of different method steps, each working step having to be carried out with different special tools.

DE 100 65 678 discloses a dishwasher with a bottom part, a top part and a rinsing container, the rinsing container comprising a plurality of parts joined together. For this purpose a framework is provided on which or round which at least one casing, consisting of at least two side parts connected together at an angle, is arranged. Consequently a number of components are required for constructing the rinsing container in dishwashers of prior art, namely at least one framework and one casing, which itself consists of several components. Such a structure of a container is expensive to design and is cost-intensive in production.

101 56 423 A 1 of the applicant discloses a dishwasher with a two-part rinsing container. A rinsing container is placed on a plastic mounting bottom, the top of the mounting bottom forming the bottom of the rinsing container.

SUMMARY OF THE INVENTION

The object of this invention is therefore to provide a dishwasher with a rinsing container having on the one hand the advantages of an inert, steel rinsing container, and on the other hand is easy to produce. A further object of the invention is to design a rinsing container for a dishwasher of the type already described so that it can easily be adapted to differing requirements predetermined by the design of a dishwasher.

This object is achieved by the device according to the invention with the features of Claim 1. advantageous further developments of this invention are identified in dependent claims 2 to 14.

The production and assembly of the rinsing container is greatly simplified by this structure, and production of the dishwasher according to the invention is therefore also less expensive. Moreover, the same bottom module and the same top part may always be used, even if the height of the rinsing container is variable; for this purpose only the casing need be constructed with a suitable height. A rinsing container for a dishwasher of the type already described can be successfully designed on the basis of this invention, so that the rinsing container is simpler to produce and can be adapted without great expense according to the specifications predetermined by the design of a dishwasher.

The modular structure of the dishwasher according to the invention also allows the use of different materials for the bottom module, the casing and the top part. The bottom module and the top part may suitably consist of plastic and the casing of refined steel or another corrosion resistant material. Chrome-nickel steel or preferably low cost chromium steel may be considered here. The combination of plastic and refined steel according to the invention means that full use is made of the advantages of the material refined steel for the side walls, the rear wall and the inner lining of the rinsing container, and of the advantages of the material plastic for constructing the top and bottom of the rinsing container. It is particularly advantageous here for all the connection measures, both on the bottom module and on the top part, to be carried out during the manufacturing process, thereby greatly simplifying the assembly of the dishwasher.

In an assembled dishwasher the rinsing container is surrounded by the casing, at least on its rear side and on the sides, is sealed at the bottom by the bottom module and is covered at the top by the top part. If the dishwasher is a so-called front loader with an open-folding front door, the rinsing container is open towards the front side when the front door is opened. In a preferred embodiment of this invention the casing therefore has a U-shaped outline. If the dishwasher is a so-called top loader, with an open-folding top part, the rinsing container is open towards the top when the top part is opened, and is otherwise closed on all sides. In a further embodiment of this invention the casing therefore has the outline of a closed rectangle. A tub-shaped rinsing container can be produced in this way, designed as a closed rectangle.

It is particularly advantageous for the casing to have openings for feeding through operating aids, e.g. rinsing aids, detergents and/or regenerating salt. The required openings may therefore be prepared, e.g. by stamping or punching, even during the production of the casing. For reasons of space it is also appropriate for the top or bottom part or casing to be fitted with additional functional elements, in particular a heat exchanger, containers for rinsing aids and/or detergents, or a water softening device.

In a further preferred embodiment of this invention the casing itself serves at least partially as a heat exchanger. Such a casing designed as a heat exchanger not only saves space but also results in a saving in assembly costs because there is no separate assembly of a heat exchanger normally provided in dishwashers. Because of the provision of as large an area of the casing as possible as heat exchanger, the degree of heat recovery and/or condensation action in a drying process can be substantially increased, thereby increasing the capacity for heat recovery during operation of the dishwasher according to the invention.

To guarantee a secure connection between the individual components of the dishwasher according to the invention, groove-shaped receiving areas and/or guide grooves are provided on the bottom module, the casing and/or the top part in the connection region between the bottom module, casing and top part, in order to support the connection underneath the components concerned. According to a preferred feature of this invention, the connection regions are formed by a groove-shaped receiving area on the bottom module and on the plastic top part, as well as on a corresponding insertion section on the edges of the refined steel casing. Here it is particularly advantageous for receiving areas and/or guide grooves which fully enclose the casing on the periphery to be formed on the bottom module and preferably also on the top part in the connection region between the bottom module, the casing and the top part.

The bottom module, the casing and/or the top part may each be connected to each other in the most suitable, different manner, for example by gluing, locking, flanging, welding, riveting, stamping or ultrasonic caulking. Here the connection between the bottom module, casing and/or top part is preferably made so that it seals without a gap and without an additional sealing element. Both the connection between the bottom module and the casing and the connection between the casing and the bottom module are preferably made so that they are sealed without a gap and without a sealing element (silicone, adhesive, silicone foam or sealing cord). The avoidance of gaps in the above-mentioned connections is particularly advantageous when using chromium-steel for the top part, in order to avoid capillary effects and corrosion. In the case of a gap-free connection no corrosion takes place on the edges of the casing, even in the case of lower quality chromium-steel compared with higher quality chromium-nickel steel.

Because of the gap-free connection of the refined steel rinsing container to the top part and bottom module of plastic, a particularly water-tight connection region is produced according to the invention. Besides meeting the water-tightness requirements, a further advantage of the dishwasher according to the invention is that an aesthetically high quality connection is produced between the bottom module, the top part and the rinsing container, since a flush connection is observed between these modules by the user who is only able to see the inner region of the rinsing container. Furthermore, the substantially joint-free connections between the bottom module, the top part and the rinsing container form a hygienic connection in which no rinsing residues are able to penetrate.

Since the wall, bottom and/or top parts are produced as separate parts, they may be suitably equipped, even during the production of the components concerned, to perform various functions. This avoids separate assembly of the functional elements concerned after the individual components have been assembled. According to a further preferred embodiment of this invention devices for mechanical functions are therefore integrated in the top part, e.g. devices for fastening a work top on a dishwasher, devices for arranging a discharge hose, devices for receiving transport aids and devices for absorbing clamping and stacking forces. Devices for mechanical functions are preferably already integrated during the production of the top part, the top part being produced, for example, as a plastic injection moulding, thereby enabling a further cost reduction to be achieved. Since hot water vapour is formed during the operation of the dishwasher, a steam protection plate is preferably integrated in the top part in order to protect an overlying work top from water damage.

BRIEF DESCRIPTION OF THE DRAWINGS

This invention is explained in greater detail in the following by means of a preferred exemplary embodiment with reference to the attached drawing, in which:

FIG. 1 shows a perspective exploded representation of the main components of a dishwasher according to a preferred embodiment of this invention.

DETAILED DESCRIPTION OF THE EXEMPLARY EMBODIMENTS OF THE PRESENT INVENTION

FIG. 1 shows the main components of a dishwasher according to a preferred embodiment of this invention, in a perspective view, the main components being shown one above the other and separated from one another in the nature of an exploded view. The dishwasher is composed in a modular fashion or sandwich design, of main components which consist essentially of bottom module 1, casing 2 and top part 3. Bottom module 1 and top part 3 are preferably produced from plastic as injection mouldings, whilst casing 2 is manufactured in one piece from a refined steel sheet, e.g. preferably chromium-steel or even chromium-nickel steel. Further functional elements are installed in bottom module 1, e.g. a pump pot, which is covered by a screen 5 for retaining rinsing residues, and a rotatably mounted spray arm 4 for spraying the objects to be washed with rinsing liquid.

Casing 2 forms side walls 7, 9 and rear wall 8 of the rinsing container of the dishwasher. The dishwasher shown in the drawing is a so-called front loader with an open-folding front door (not shown). Casing 2, in the embodiment of this invention shown, therefore has a U-shaped outline with two side walls 7, 9 and a rear wall 8, so that the rinsing container is open towards the front side when the folding door is open.

Groove-shaped receiving areas 6 and guide grooves 6 are formed on bottom module 1 and top part 3 in the connection region between bottom module 1 and top part 3 with casing 2 in order to support the connection of the main components 1, 2, 3 concerned. The connection regions between bottom module 1, casing 2 and top part 3 are each formed by a groove-shaped receiving area 6 on bottom module 1 and on plastic top part 3 and a corresponding insertion section on the appropriate edges 10 and 11 of refined steel casing 2. Here it is particularly advantageous for groove-shaped receiving areas and guide grooves 6, which fully cover edge 10, 11 of casing 2 on the periphery, to be formed on bottom module 1 and preferably also on top part 3 in the connection region between bottom module 1, casing 2 and top part 3. In this manner lower edge 10 of casing 2 is fully covered by a connecting groove 6 on the periphery of bottom module 1 in the connection region with bottom module 1, and upper edge 11 of casing 2 is fully covered by a connecting groove on the periphery of top part 3 in the connection region with top part 3. Guide grooves also serve to support the process of combining and connecting main components 1, 2, 3 when manufacturing the dishwasher according to the invention.

Bottom module 1, casing 2 and top part 3 are each connected to one another so that a connection of components 1, 2, 3 that is as water-tight and gap-free as possible is guaranteed. Both the connection between bottom module 1 and casing 2 and the connection between casing 2 and bottom module 3 are made so that they are gap-free and water-tight without an additional sealing element.

The modular structure of the dishwasher according to this invention enables main components consisting of different materials to be used, for example components of plastic or metal. Because of the modular structure of the dishwasher according to the invention, with a solid casing 2, modifications to the dimensions of the rinsing container can also be carried out more easily and at lower cost. Different heights of the rinsing container may be obtained, e.g. merely by suitable dimensional modifications of casing 2. Low cost chromium-steel may be used for casing 2, which results in a further cost reduction.

LIST OF REFERENCE NUMBERS

1 Bottom module
2 Casing
3 Top part
4 Spray arm on bottom module 1
5 Screen in bottom module 1
6 Groove-shaped receiving areas and guide grooves on bottom module 1
7 Side wall of casing 2
8 Rear wall of casing 2

9 Side wall of casing 2
10 Lower edge of casing 2 in the connection region
11 Upper edge of casing 2 in the connection region

The invention claimed is:

1. A dishwasher comprising:

a bottom module; and a frameless rinsing container having a bottom, side walls, and a top wall, the bottom module forming the bottom of the rinsing container and the top wall of the rinsing container including a separate top part.

2. The dishwasher according to claim 1, wherein the top wall and the side walls of the rinsing container are formed from different materials.

3. The dishwasher according to claim 1, wherein the side walls of the rinsing container is formed from a solid casing substantially of at least one of refined steel and chromium steel, and wherein the bottom module and the top part are formed substantially from plastic.

4. The dishwasher according to claim 1, wherein the rinsing container has a U-shaped outline.

5. The dishwasher according to claim 1, wherein the rinsing container has the outline of a closed rectangle.

6. The dishwasher according to claim 1, wherein the rinsing container has openings for feeding operating aids.

7. The dishwasher according to claim 1, wherein the rinsing container is fitted with additional functional elements including at least one of a heat exchanger, a container for rinsing aids and detergents, and a water softening device.

8. The dishwasher according to claim 1, wherein the rinsing container itself serves at least partially as a heat exchanger.

9. The dishwasher according to claim 1, wherein the bottom module includes at least one of groove-shaped receiving areas and guide grooves, at least one of the rinsing container and the top part being provided in connection regions between the bottom module, the rinsing container and the top part in order to support the connection of the components concerned.

10. The dishwasher according to claim 9, wherein at least one of the receiving areas and the guide grooves which fully enclose the rinsing container on the periphery are formed on the bottom module and also on the top part in each connection region between the bottom module, the rinsing container and the top part.

11. The dishwasher according to claim 1, wherein the bottom module, the rinsing container and the top part are connected to each other by at least one of gluing, locking, flanging, welding, riveting, stamping and ultrasonic caulking.

12. The dishwasher according to claim 1, wherein the connections between the bottom module, the rinsing container and the top part are made so that they seal without an additional sealing element.

13. The dishwasher according to claim 1, wherein devices for mechanical functions are integrated in the top part for fastening a work top on top of the dishwasher, for arranging a discharge hose, for receiving transport aids and for absorbing clamping and stacking forces.

14. The dishwasher according to claim 1, wherein a steam protection plate is integrated in the top part.

15. The dishwasher according to claim 1, wherein the bottom module includes one of a pump pot covered by a screen for retaining rinsing residues, and a rotatably mounted spray arm for spraying objects to be washed with rinsing liquid in the rinsing container.

16. A modular structure for a dishwasher, the modular structure comprising:

a frameless rinsing container including:

a plurality of side walls;

a top wall that is separate from the side walls; and a bottom module that is separate from the side walls.

* * * * *